US006648052B2

(12) United States Patent
Marzari Chiesa et al.

(10) Patent No.: US 6,648,052 B2
(45) Date of Patent: Nov. 18, 2003

(54) SECTIONAL DOOR WITH PANEL ALIGNING ABUTMENT

(75) Inventors: Gustavo Marzari Chiesa, Chieri (IT); Renzo Boschello, Padova (IT)

(73) Assignee: Brement Brevetti Metecno SpA, Spilimbergo (IT)

( * ) Notice: Subject to any disclaimer, the term of this patent is extended or adjusted under 35 U.S.C. 154(b) by 0 days.

(21) Appl. No.: 09/870,477

(22) Filed: Jun. 1, 2001

(65) Prior Publication Data

US 2002/0139490 A1 Oct. 3, 2002

(30) Foreign Application Priority Data

Apr. 3, 2001 (EP) ..... 01830231

(51) Int. Cl.[7] ..... E05D 15/06

(52) U.S. Cl. ..... 160/201; 160/229.1; 160/232; 16/355

(58) Field of Search ..... 160/201, 229.1, 160/207, 232, 235, 236; 16/355, 380

(56) References Cited

U.S. PATENT DOCUMENTS

| | | | | |
|---|---|---|---|---|
| 3,104,699 A | | 9/1963 | Wolf et al. | |
| 4,893,666 A | * | 1/1990 | Hormann | 160/229.1 |
| 5,002,114 A | | 3/1991 | Hormann | |
| 5,133,108 A | * | 7/1992 | Esnault | 16/225 |
| 5,148,850 A | * | 9/1992 | Urbanick | 160/231.1 |
| 5,327,616 A | * | 7/1994 | Lautenschlager | 16/382 |
| 5,355,559 A | * | 10/1994 | Bowers et al. | 16/389 |
| 5,566,740 A | | 10/1996 | Mullet et al. | |
| 5,669,431 A | * | 9/1997 | Druzynski et al. | 160/229.1 |
| 5,915,444 A | * | 6/1999 | Sastri et al. | 160/229.1 |
| 5,927,369 A | * | 7/1999 | Pedersen | 160/201 |
| 6,006,817 A | * | 12/1999 | Stone et al. | 160/201 |
| 6,076,590 A | * | 6/2000 | Ford et al. | 160/229.1 |
| 6,328,091 B1 | * | 12/2001 | Whitley | 160/201 |
| 6,363,993 B1 | * | 4/2002 | Aquilina | 160/229.1 |
| 6,397,919 B1 | * | 6/2002 | Lamsfuss | 160/201 |

FOREIGN PATENT DOCUMENTS

| | | |
|---|---|---|
| DE | 4019569 A1 | 1/1992 |
| DE | 19855479 A1 | 7/1999 |
| EP | 0326131 B1 | 8/1989 |
| EP | 0370324 B1 | 5/1990 |
| EP | 0370376 B2 | 5/1990 |
| EP | 0943776 A1 | 9/1999 |

* cited by examiner

*Primary Examiner*—Bruce A. Lev
(74) *Attorney, Agent, or Firm*—Birch, Stewart, Kolasch & Birch, LLP

(57) ABSTRACT

Sectional doors for garages, industrial warehouses and the like are formed by panels joined together in an articulated manner by hinges. Advantageously, the bottom edge of each panel is provided with a tapered lug which, at the end of the rotation during closure of the door, abuts against the inclined flank of the edge of an underneath panel. The abutment thus formed ensures the correct vertical alignment of the panels, thereby providing the door with a smooth operation and appearance.

11 Claims, 4 Drawing Sheets

SECTIONAL DOOR WITH PANEL ALIGNING ABUTMENT

The present invention relates to doors and gateways of sectional type.

As is known, with this definition there are commonly referred to doors and gateways intended for closing garages, sheds or the like, formed by panels hinged together to form a folding structure which is raised and lowered vertically for opening and closing thereof, likewise a shutter.

The aforementioned panels are generally made outside of sheet metal and filled inside with heat-insulating materials, such as polyurethane foam, rock wool, polystyrene and the like; there also exist, however, internally empty panels or others which are made with materials different from sheet metal, such as plastics, wood, aluminium and the like, whose structure may differ considerably from that described above.

What is of interest here is the fact that in order to make doors and gateways safe during the opening and closing operations (which may be manual or motorized, depending on the circumstances), it is known to shape the top and bottom edges of the panels forming them, with a convex portion and a concave portion respectively, having matching profile.

In particular, the radius of curvature of these portions coincides substantially with their distance from the axis of the hinges connecting the panels: in this manner there is delimited an interspace of sufficiently small width between the concave and convex portions, so as to prevent during rotation of the panels following opening or closing of the sectional door, a person's fingers from being accidentally introduced therein.

This shaped configuration of the panels edges has been well-known since a long time and for this reason nearly all the panels of sectional doors are nowadays made according thereto; among the several prior documents attesting this state of the art, it is only mentioned here the European patent No. 326 131 dating back to 1988 and owned by the company Niemetz Torsysteme.

However, if on the one hand the aforementioned configuration is able to achieve advantageous results in terms of safety, on the other hand it may give rise to certain difficulties during installation of the doors with regard to precise alignment of the panels along the vertical direction.

This alignment is important because some important effects depend on it, such as smooth sliding of the doors during closing and opening thereof or their external appearance: it can indeed be understood that if the panels are not properly aligned, the surface of the door appears to an observer as being undulating or in any case not smooth, thereby resulting unaesthetic.

At present, in order to align the panels vertically as required in the closed condition of the doors, two way are mainly followed: using the joining hinges so that one of their arms abuts against the wall of the panels when they lie vertically, or resting the panels endwise, on one another, when the door is closed.

The first solution is illustrated in the Niemetz patent, whereas the second solution is described in two further published prior documents: European patent Nos. 370,324 and 370,376, both in the name of Hörmann KG Brockhagen.

The latter relate to panels for sectional doors wherein further to the concave and convex portions, the top and bottom shaped edges are provided with horizontal flat zones for resting the end of the panels when, following the relative rotation about the respective articulating hinges, they are in the vertically aligned condition.

Furthermore, in one case (patent No. 370,376), the edges of the panels are shaped so as to have stepped zones close to the internal wall, where the hinges for joining the panels may be arranged; these zones are also used for resting the end of the panels.

There are however some limitations which make the known panels considered above unsatisfactory from certain points of view.

As regards the type of panel described in the already mentioned Niemetz European patent, it may be noted that the vertical alignment in the sectional doors depends on the hinges connecting the panels, in the sense that their entire weight bears on said hinges: this weight may also be considerable in the case of large-size gateways, so that the hinges must be made with suitable dimensions and therefore the associated costs also increase as a result.

There is also another important aspect, which relates to safety.

The arm of the hinges which abuts against the front wall of the panels when they are in vertical alignment, tends to move away from the wall itself when the panels rotate during opening or closing of the door, with the result that a person could accidentally introduce a finger into this space, with the risk of serious injury.

It is for this reason that the hinges in the Niemetz patent are provided with special lateral covering flanges which prevent any possibility of fingers being introduced into the zone where the hinge arm is situated.

For the same safety reasons, the hinges joining the panels in the first mentioned European patent to Hörmann, have curved arms: in this way, in fact, there is no risk of fingers remaining trapped between the arm and the inner wall of the panels, following relative rotation of the latter during closing or opening of the door.

In this case, however, the curved shape of the arm is unable to provide the bearing surface required for correct mutual positioning of the panels along the vertical and therefore this function is obtained by resting them endwise, one on top of the other when the door is in the closed condition.

This resting arrangement of the panels is also envisaged in the other Hörmann European patent which differs from the preceding one in that the shaped edges of the panels have stepped zones, which are close to the inner front wall and between which the pivots of the hinges are positioned.

This positioning arrangement, however, does not allow the arms of the hinges to abut against the wall of the panels: this function is therefore obtained by resting the panels endwise in respective flat zones adjacent to the concave and convex portions of their shaped edges.

It can be easily appreciated that the endwise resting of the panels described in the prior documents above, ensures that they do not bear with their whole weight on the joining hinges as instead occurs in the case of the Niemetz patent; as a matter of consequence it is possible to avoid the abovementioned difficulties resulting from the use of strong and hence costly hinges.

However, the abovementioned resting arrangement gives rise to problems concerning the mounting of the sectional doors.

It can indeed be understood that the panels must be joined together in a precise manner to ensure that, at the end of their relative rotation, they assume the vertically aligned condition resting one on the top of the other; this requires small tolerances, both in the design of the panels and assembling thereof.

Furthermore, it can be assumed that in the event of thermal expansions, deformations, cave-in give or plays between the joined panels, small changes in their relative position occur which however may result in significant modifications of their operating condition.

For example, it can be noted that when an upper panel rests endwise on a lower panel at the conclusion of their relative rotation during closing of the sectional door, inevitably the weight of the former is transmitted to the latter through the respective horizontal contact zones; in the long run this may cause wear, deformation or crusching of the zones concerned, such that the panels no longer fit together as they should and therefore their vertical alignment is also adversely affected as a matter of consequence.

In other words it may be stated that the configuration of the panels described in the Hörmann patents does not allow to offset their variations with respect to the initial condition, which may arise with time and with use.

The present invention aims at remedying this state of the art: that is to say, it has the object of providing a sectional door with panels suitable to overcome the drawbacks mentioned above in relation to the known ones.

This object is achieved by a door whose features are set out in the claims appended to this description.

The invention will be better understood in the light of the explanation provided below, with reference to a few non-limiting examples thereof illustrated in the accompanying drawings wherein.

Figure 2:
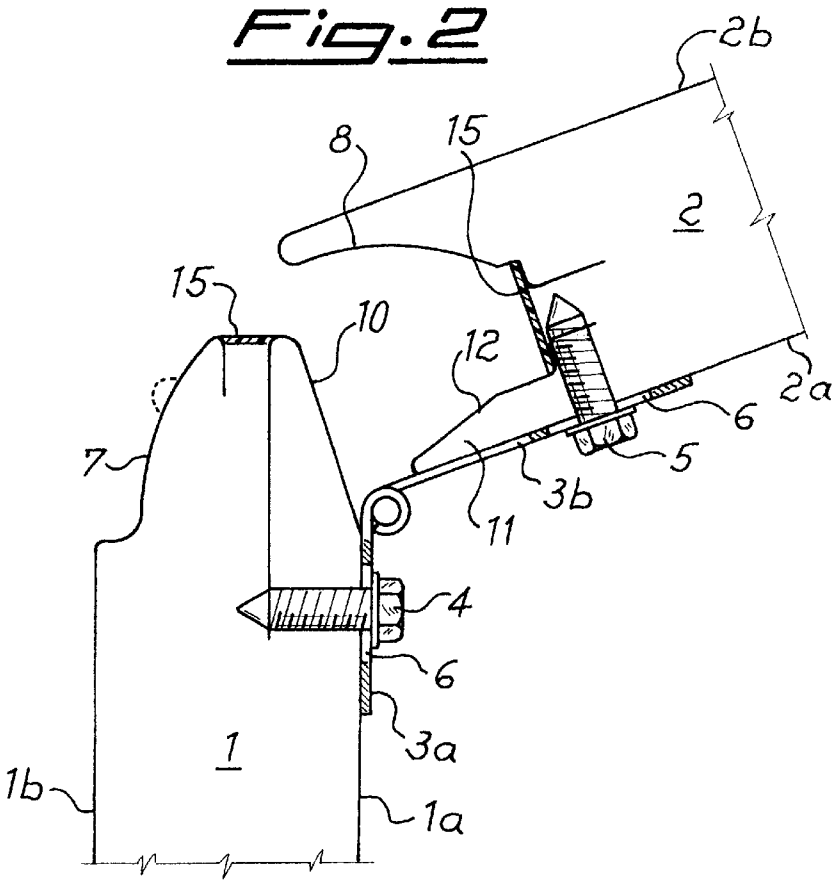
FIG. 2 shows the panel portions of the preceding figure, in a condition rotated with respect to each other.

the pairs of FIGS. 3–4, 5–6, and 7–8 show respective alternative examples of panels for sectional doors according to the invention.

With reference to the figures, the first two thereof show the respective shaped top and bottom edges of a pair of hinged panels 1 and 2 in a sectional door according to the invention.

It just needs to be added that the door is formed by a plurality of these panels which are identical to each other and therefore the accompanying figures show, for the sake of simplicity, only the joined portions of two of them; nevertheless since the panels are identical each edge visible in the drawings corresponds to the edge of the other one, which is not shown.

The panels herein consist respectively of two opposite front walls or sides 1*a*–1*b*; 2*a*–2*b* which are joined at their top and bottom ends by respective shaped edges coupling with each other in the manner which will be better described afterward.

The walls 1*a*, 2*a* are inner in the sense that they are directed towards the area (garage, warehouse, store, etc.) closed by the sectional door, whereas the opposite walls 1*b*, 2*b* are outer.

The arms 3*a*, 3*b* of the hinges 3 joining together the panels are respectively fixed onto the inner walls 1*a*, 2*a* by means of screws 4 and 5.

In accordance with a preferred embodiment, the holes 6 for the screws (present in the arms 3*a*, 3*b*) are slot-shaped; this allows the position of the panels to be adjusted, as will be explained more fully below.

In this connection it must be pointed out that although only one hinge is visible in the drawings, the articulated connection between the panels in the sectional door is ensured by several hinges which are distributed along their edges, as commonly occurs in known sectional doors.

It should also be added that even if the panels shown in the drawings are of the type made externally of folded sheet metal defining the inner and outer front walls, it is obvious, however, that they could also be made differently.

For example, the panels might be made with or without insulating material inside the sheet metal, or the latter could be also dispensed with: reference should be made to panels made wholly of wood, plastics and the like.

This foreword having been made, the shaped top and bottom edges of each panel have the respective usual convex portion 7 and concave portion 8 with matching profile, which define an interspace 9 of limited width so as to prevent the introduction of people fingers during the relative rotation of the panels following opening or closing of the door.

As can be seen, in this embodiment of the invention the top edge of the panels (corresponding to the one of the panel 1 visible in FIGS. 1 and 2) has an inclined and upwardly converging abutment flank 10 extending from internal front wall 1*a*.

The bottom edge of the panels (corresponding to the one of the panel 2 in FIGS. 1 and 2) has instead a tapered lug 11 defined by the end part of the inner wall 2*a* and a surface 12 inclined with respect thereto, at an angle equal to the angle of inclination of the flank 10 with respect to the vertical.

In the bottom edge of the panel 2, the surface 12 defines together with the concave portion 8 a seat which is provided at the bottom with an elastic strip 15 of rubber or the like, having the function of sealing member for the inside of the panel; a similar strip also seals the end of the top edge of panel 1.

From the operation point of view, the sectional door formed by the panels according to the foregoing works as described below.

During opening and closing, the panels rotate with respect to each other about the axes of the hinges 3 in a manner similar that of the known doors.

However, when, at the end of rotation the panels are arranged along the vertical, the surface 12 of upper panel 2 comes into contact with the inclined flank 10 of lower panel 1; this contact ensures the correct relative positioning of the panels in a different manner from what occurs in present state of the art.

Indeed, it may be appreciated that in this case, unlike what is disclosed in Hörmann European patents, the upper panel 2 does not abut with the whole of its weight on the shaped edge of the lower panel since, owing to the inclination of the flank 10 of the latter, the weight is distributed partly on this flank and partly on the hinge 3.

This distribution depends on various factors such as the angle of inclination of the flank 10 and the surface 12, the positioning (upper or lower) of the axis of the hinges 3, the materials from which the panels and their contact zone are made that influence the relative friction between them, and so on.

Basically the configuration of the shaped edges of the panels allows that both the hinges and the edges themselves to contribute for supporting the weight of the vertically aligned panels in the closed condition of the sectional doors.

The result is that, on the one hand the hinges need not be designed with too large dimensions and, on the other hand, the contact zones of the shaped edges of the panels are not excessively stressed.

Further important features of the invention must also be pointed out.

First it must be considered how the tapered shape of the lug 11 provides the latter with a resilient behaviour which allows it to flex slightly following contact between its surface 12 and the inclined abutment flank 10, when the panels are aligned.

As a result of this resilient behaviour it is possible to compensate for the small degree of play existing between the arms 3*a*, 3*b* of the hinges and the inner front wall 1*a*, 2*a* of the panels, as well as ensure the correct alignment of the latter also in the case of slight yieldings or assembly errors, slackening of the screws 4 and 5, thermal or loading deformation of the panels, as well as wear of their contact zones and any other situation when there is a deviation between the real operating condition of the sectional doors and those of ideal design.

Figure 1:
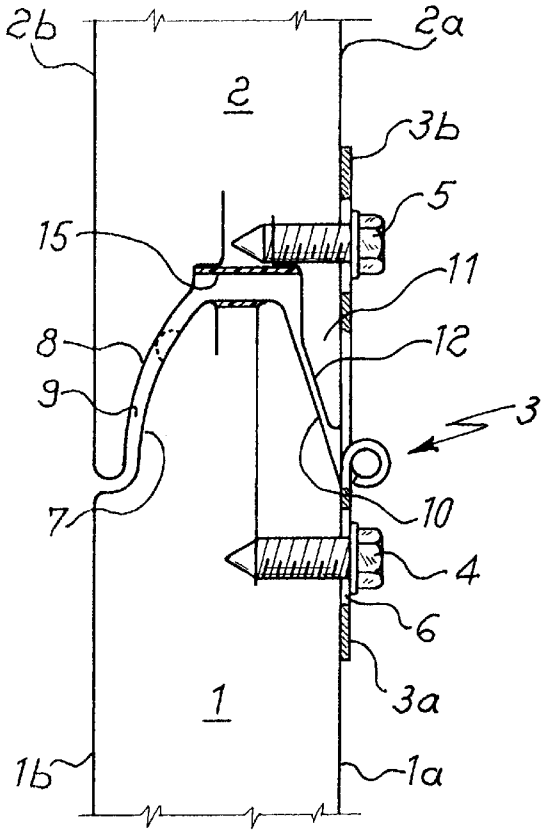
FIG. 1 shows a side view of the portions of two hinged panels in a sectional door according to the invention, in the vertically aligned condition.

In this connection it must also be emphasized how the abovementioned tapered form of the lug 11 allows the adjustment "in situ" of the door panels; for this purpose, according to a preferred embodiment of the invention the holes (as numbered in the drawings) provided in the arms 3*a*, 3*b* of the hinges for the screws 4 and 5 are advantageously slot-shaped in the vertical direction (with reference to FIGS. 1 and 2).

This shape allows indeed the displacement upwards or downwards of the hinges with respect to the panels joined together by them; such a possibility facilitates adjustment of the doors during installation, which may be performed as described below.

When the panels are joined together by mounting the hinges 3, the screws 4 and 5 of the latter are only partly tightened: as a result it is possible, once the door has been completed, to assess the state of alignment of the panels forming it.

In the case where adjustment thereof is necessary, for example in order to ensure the respective external front walls 1*b*, 2*b* being coplanar, the tapered form of the lug 11 with its angled surface 12 allows making the upper panel 2 to slide along the inclined flank 10 of the lower panel 1, until the desired adjustment is achieved.

This sliding is assisted by screwing the screws 4 and 5 more or less into the panels 1 and 2 and by displacing the hinges 3 upwards or downwards with respect to the panels, with the aid of the aforementioned slot-shaped holes present in their arms 3*a*, 3*b*.

Another important aspect achieved by the invention consists in the fact that the resting of the lug 11 of the upper panel 2 along the inclined bearing flank 10, provides a seal avoiding air from passing from one side to the other of the sectional door.

Indeed, referring to the drawings it can be easily understood that without the aforementioned resting arrangement, the external and internal environments located on opposite sides of the door, would be in communication with each other via the interspace 9 and the free space between the lug 11 and the inclined flank 10.

The contact between the latter, however, prevents the air from passing from the internal to the external environment and vice versa, thus improving the thermal insulation provided by the door.

It is however obvious that this situation does not exclude the use of additional seals as normally occurs in the present state of the art, for example by arranging them in the interspace defined between the convex and concave portions 7 and 8 of the joined panels (in FIGS. 1 and 2 the shape of such a seal is shown in broken lines).

Seals may also be provided on the inclined flank 10 and/or on the angled surface 12 of the lug 11, as will be explained more fully below.

Finally, a further important effect obtained by the invention is the safety of the articulated joint between the panels 1 and 2.

Indeed, whereas regarding the function of the concave and convex portions to this purpose reference should be made to what already known from the state of the art, it should instead be pointed out that the arms 3*a*, 3*b* of the hinges 3 are arranged adjacent to the internal walls 1*a*, 2*a* of the panels 1 and 2, so that there is no danger arising from them during rotation of the panels.

It should be noted that this result does not require the use of special hinges with protective flanges, like those described in previously mentioned European patent No. 326,131.

Furthermore it must be pointed out that the lug 11 ensures that the relative movement of the two panels 1 and 2, be safely performed during their rotational movements.

Indeed, by suitably choosing the length of the lug 11 it is possible to ensure that the distance between the inner walls 1*a* and 2*a* of the panels 1 and 2, namely the space between the tip of the lug and the edge from where the inclined bearing flank 10 protrudes, is small (preferably between about 3 and 5 mm) thereby preventing fingers from being accidentally introduced and trapped during rotation of the panels.

In this connection it must also be pointed out that the positioning of the axis of the hinges in the aforementioned space between the tip of the lug and the edge from where the inclined flank 10 protrudes, is advantageous because in this way the arms 3*a*, 3*b* of the hinges which extend therefrom adhere to the respective inner walls 1*a*, 2*a* of the panels, so as to avoid any risk of trapping fingers.

Figure 4:
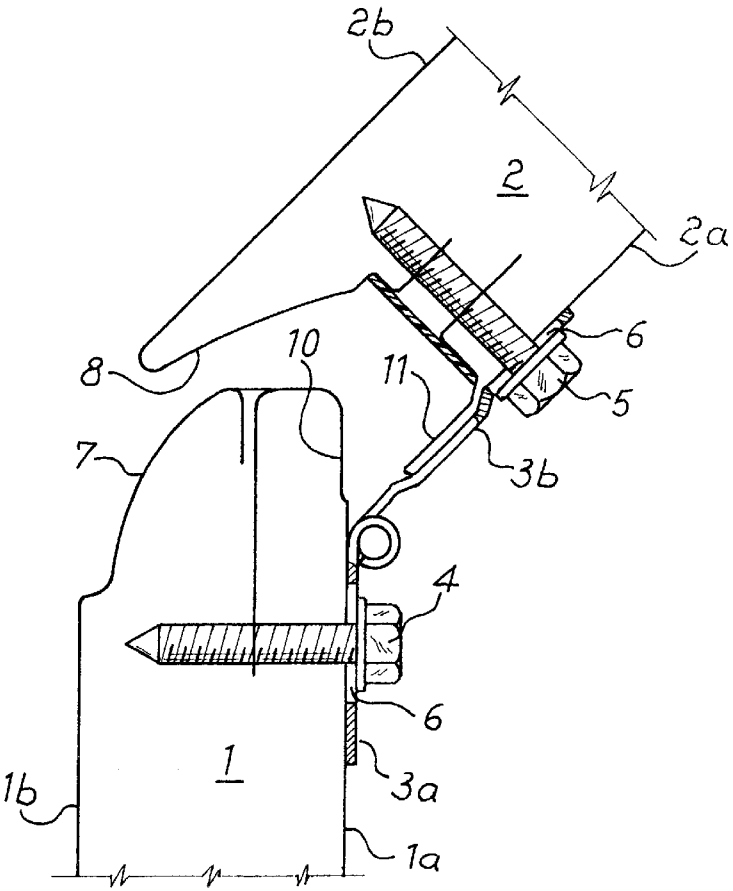
Figure 3:
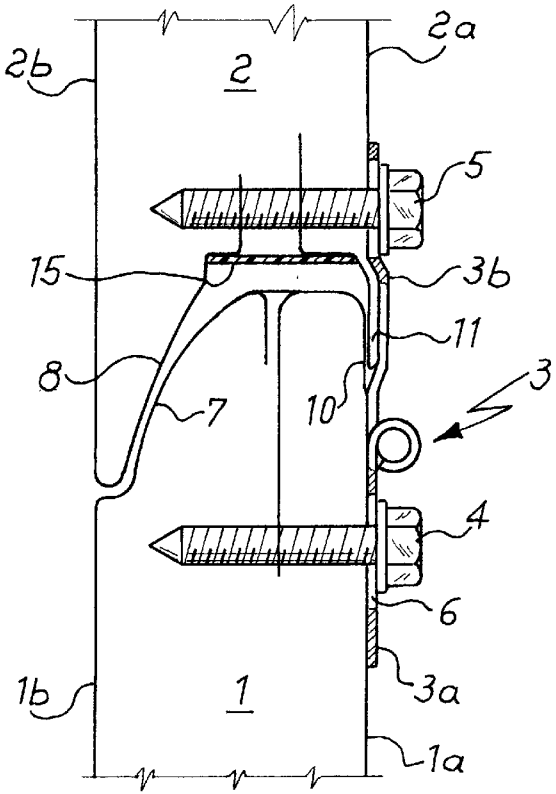

Of course variants with respect to the example of the invention described above are possible: one of them is illustrated in FIGS. 3 and 4 which show a second example, in respective operating conditions corresponding to those shown in FIGS. 1 and 2, with the same numbering.

Basically this second example differs from the preceding one in that the lug 11 is in the form of a lamina; in the case where, as in FIGS. 3 and 4, the panels are formed externally by sheet metal, the lug 11 is obtained by folding the end of the inner wall 2*a* of the upper panel 2.

As can be seen from the drawings, the inclined abutment flank is absent in the sense that it is incorporated in the end part of the inner wall 1*a* of the panel 1, therefore being no longer inclined with respect thereto.

The lug 11 in any case bears against the flank 10 at the end of rotation of the panels and its lamina-like configuration provides it with the necessary elasticity for obtaining the effects explained further above.

In this connection it must be pointed out that between the lug 11 and the arm 3*b* of the hinges, there is nevertheless a certain play resulting also from the shaped form of these arms which allows suitable (not excessive) deformations of the lug. It must also be remembered that the lug 11 runs along the entire edge of the panel 2, whereas the hinges are instead mounted in a limited number of points (two, three or more): the action of the lug is therefore to be regarded as uniformly distributed along the whole length of the panels.

In this example of the invention it is therefore also possible to perform adjustment of the panels during installation of the sectional door, in accordance with what has been explained above, by adjusting the screwing of the screws 4 and 5 and the position of hinges 3 higher or lower with respect to the panels 1 and 2, by means of the slot-shaped holes present in the arms 3*a*, 3*b*.

Figure 6:
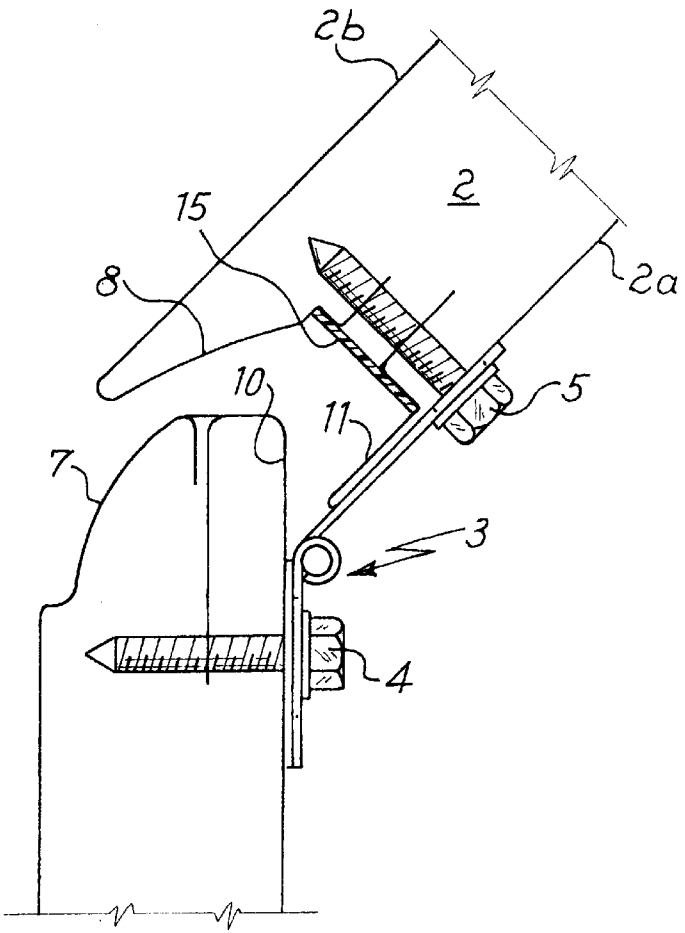
Figure 5:
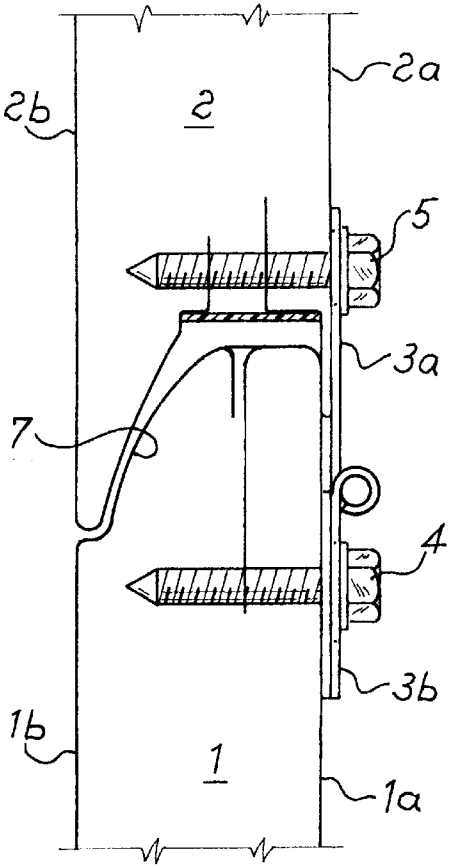

In FIGS. 5 and 6 there is shown a solution similar to that considered above and which differs from it in that the lamina-shaped lug is flush with the inner front wall 2*a* of the associated panel 2.

This solution allows the use of hinges with flat arms, that is to say not shaped according to the profile of the lug.

Finally, referring back to what has been brought forward above in connection with the first example of the invention, it must be pointed out that the contact surfaces of the panels 1 and 2 may be formed by seals or strips of rubber and the like (neoprene, teflon or whatever else), instead of the external sheet metal of the panels like in the cases considered.

Figure 8:
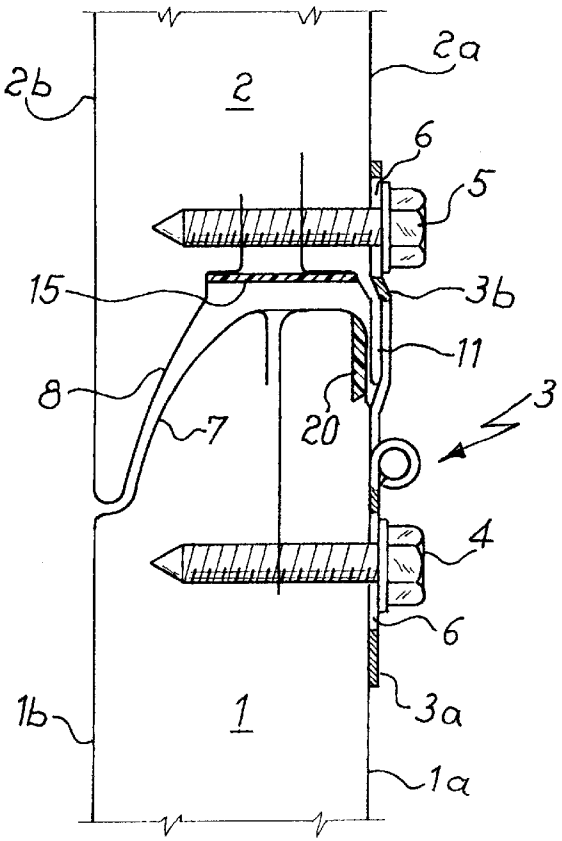
Figure 7:
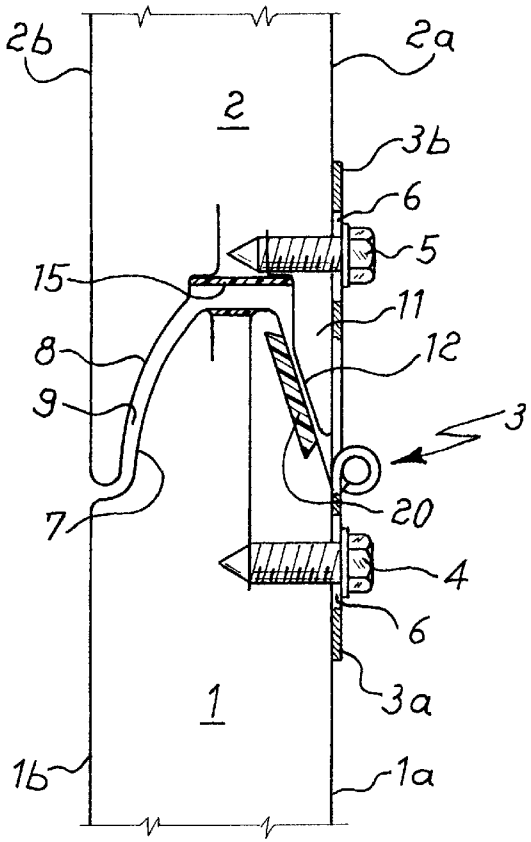

For this purpose reference should be made by way of example to the two possible solutions shown in FIGS. 7 and 8, respectively, where these seals have been indicated by 20.

As can be seen from the first of said figures, the inclined flank or at least the part thereof against which the lug 11 abuts, is formed by a strip 20; the latter is preferably housed in a recess formed in the surface of the aforementioned flank. However, such a recess could also be absent and the strip be applied by means of suitable adhesives or other systems, on the smooth surface of the abutment flank.

This solution prevents wear of the lug and facilitates the seal resulting from the contact between it and the inclined flank, which seal prevents air from passing from one side to the other of the sectional door.

The bearing contact of the upper panel 2 on the lower panel 1 is also increased by this variant of the invention, because the friction coefficient of the rubber strip 20 is greater than that of the sheet metal alone, so that the distribution of the weight referred to before is also modified with respect to the example illustrated in FIG. 1.

Similar considerations are also applicable to the variant shown in FIG. 8, where the part of the shaped edge of the panel 1 against which the lug 11 abuts is also formed by a strip 20 of rubber or the like fixed in a recess in the bearing flank 10.

It goes without saying that the abovementioned strips 20 could be applied on the lug 11 instead of on the bearing flank 10 of the panels.

All these and any other similar variants nevertheless fall within the scope of the claims which follow.

What is claimed is:

1. Sectional door comprising a plurality of panels joined together in an articulated manner by hinges having a horizontal axis of rotation, said panels having an inner front wall and an outer front wall situated opposite to each other and joined at their top and bottom ends by corresponding top and bottom shaped edges, said edges comprising respectively a convex portion and a concave portion having a matching profile joined to the outer front wall, wherein the bottom shaped edge and the top shaped edge of the panels comprise respectively a lug and an abutment flank extending at the ends of the inner front wall, and in that the lug of an upper panel in the door abuts on the bearing flank of an underlying panel in the closed condition of the door, co-operating therewith for the vertical alignment of the panels in this condition, wherein both arms of the hinges are provided with holes for fixing screws, which have the shape of a slot elongated in the vertical direction with reference to the closed condition of the door so that relative positions of the panels may be adjusted while vertically resting on one another.

2. Sectional door according to claim 1, wherein the abutment flank of the top edge of a panel is inclined with respect to the front wall from which it extends converging upwards, and wherein said lug has a profile tapered towards the tip and has a contact surface on the side directed towards the opposite front wall of the panel, so that this surface rests on the inclined bearing flank of an underlying panel in the closed condition of the door.

3. Sectional door according to claim 2, wherein the contact surface and the inclined flank are substantially flat.

4. Sectional door according to claim 3, wherein the hinges for joining the panels comprise arms extending from an axis of rotation located substantially between the tip of the lug of an upper panel and the start of the inclined flank of a lower panel, and wherein the arms of the hinges are respectively fixed to the inner front walls of the joined panels.

5. Sectional door according to claim 4, wherein the distance between the tip of the lug of an upper panel and the edge from which the inclined flank of a lower panel extends, is less than 5 mm.

6. Sectional door according to claim 1, wherein said lug is in the form of a lamina so as to bend elastically following bearing contact against said abutment flank in the closed condition of the door.

7. Sectional door according to claim 6, wherein the lug and the abutment flank are substantially flat and parallel to the inner front wall from which they extend.

8. Sectional door according to claim 7, wherein the hinges joining the panels comprise arms extending from an axis of rotation arranged at a tip of the lug, and wherein the arms of the hinges are respectively fixed to the inner front walls of the joined panels.

9. Sectional door according to claim 1, wherein the lug is formed by folding the bottom end of the inner front wall of the panels.

10. Sectional door according to claim 9, wherein the inner front wall or at least the part thereof in which the lug is formed, is made of sheet metal.

11. Sectional door according to claim 1, wherein at least one of the abutment flank and the lug of the panels are provided with seals made of rubber or other elastomeric materials.

* * * * *